United States Patent [19]

Gettner

[11] 4,387,473

[45] Jun. 14, 1983

[54] PATIENT HANDLER

[76] Inventor: Donald F. Gettner, Charter Oak, Iowa 51439

[21] Appl. No.: 45,616

[22] Filed: Jun. 5, 1979

[51] Int. Cl.[3] ..... A61G 7/08; A61G 7/10

[52] U.S. Cl. ..... 5/81 B; 5/83

[58] Field of Search ..... 5/81 R, 81 B, 83, 84, 5/85, 86, 87, 88, 89, 77, 74, 57 C; 297/278, 279, 380, 381, 433, 434

[56] References Cited

U.S. PATENT DOCUMENTS

| | | | |
|---|---|---|---|
| 425,248 | 4/1890 | Peck | 297/433 |
| 564,253 | 7/1896 | McCaffrey | 297/433 |
| 568,134 | 9/1896 | Gable | 297/433 |
| 787,760 | 4/1905 | Higgins | 297/278 |
| 1,477,110 | 12/1923 | Cross | 297/278 |
| 1,971,294 | 8/1934 | Bunker | 5/81 B |
| 2,368,390 | 1/1945 | Winter | 5/86 |
| 2,609,862 | 9/1952 | Pratt | 5/86 |
| 2,633,896 | 4/1953 | Thompson | 297/433 |
| 2,827,807 | 4/1958 | Skeoch | 297/380 |
| 2,891,256 | 6/1959 | Scully | 5/87 |

*Primary Examiner*—Alexander Grosz
*Attorney, Agent, or Firm*—Hiram A. Sturges

[57] ABSTRACT

A patient handler having three panels hingably attached to each other which can be formed into either a sitting or a prone position, and having support assemblies for use in maintaining the patient handler in a given position, the patient handler being connectable to a carriage assembly which allows the patient handler to be moved to different locations when being in use by a patient.

9 Claims, 7 Drawing Figures

PATIENT HANDLER

BACKGROUND OF THE INVENTION

This invention is in the field of devices for assisting in the movement of a patient from a lying to a sitting position, or vice-versa.

Many patient handlers of the past are so bulky, and cumbersome to use, that after nurses try them a time or two, they are set aside and gather dust.

A major objective of this invention is to provide a patient handler having a single set of stiff braces which are used in maintaining the patient handler in either a sitting or a prone position. The use of a single brace which functions in more than one way, cuts down the weight of the patient handler, and thus makes it easier to handle and transport. This is especially helpful for nurses who are of a small build.

Another objective of this invention is to provide a handler having sections in rigid horizontal alignment, for the shifting of a prone bed patient onto the handler, yet capable of assuming chairlike positions simply by adjusting the panels of the handler. This requires only two steps. There is no need to spend a great deal of time in rearranging chains, or in going through similar proceedures, as is often necessary in proposals of the past.

A further objective of this invention is to provide a patient handler which can be both moved and adjusted by one person who is working alone.

When my patient handler is lifted off of the bed, it can automatically take on a sitting position. This is accomplished by simply hooking the appropriate rings onto the carriage assembly when the patient handler is lifted from the bed. Similarly, when placed on a bed, it can easily take on a prone position.

SUMMARY OF THE INVENTION

A major goal of this invention is to provide a patient handler having three panels hingably attached to each other which can be formed into either a sitting or a prone position, and having support assemblies for use in maintaining the patient handler in a given position, the support assemblies being of various types such as: stiff braces, telescoping shaft assemblies and flexible handler holders, and being easily releasable so that the position can be easily changed.

A furthur goal of this invention is to provide a carriage assembly operatively associated with the patient handler for use in allowing for easy movement of the patient handler to different locations.

DESCRIPTION OF THE PREFERRED EMBODIMENT

Figure 1:
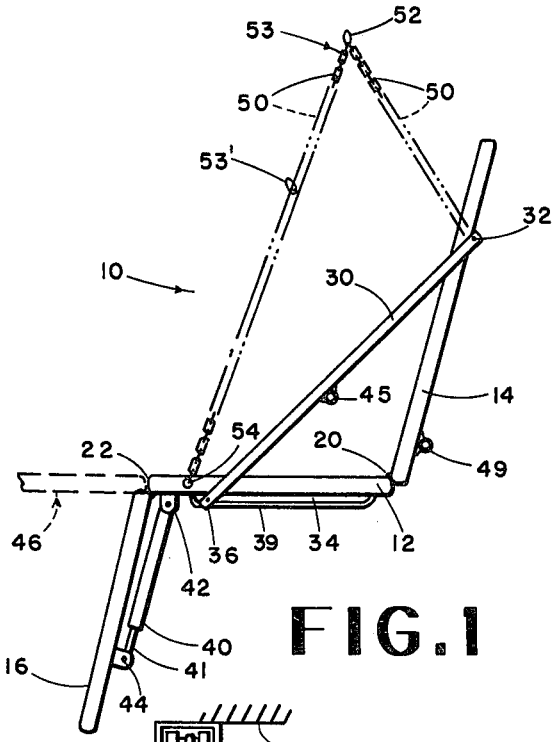
FIG. 1 is a side elevation of the lower section of the patient handler of this invention as it would be seen when in a position suitable for a patient in a sitting position, a flexible handler holder being partially shown diagramatically in dotted lines.

FIG. 1 illustrates a patient handler 10 comprising a back panel 14 adjacent to a buttocks panel 12, connected together by means of a hinge 20. At the end of the buttocks panel 12 opposite the hinge 20, is a leg supporting panel 15 which is attached to the buttocks panel 12 by a second hinge 22.

A right and left stiff brace 30 extend from the back panel 14 at right and left first points 32 respectively to a tracking slot 34 below the buttocks panel 12 and extending parallel thereto, and disposed between the buttocks panel and the right and left track bars.

An anchor opening 45 is attached to both the right and the left stiff brace and disposed between the first points 32 and the tracking slot 34.

A telescoping shaft assembly 40 is pivoted to the bottom of the buttocks panel 12 by a panel connection 42, and is pivoted to the bottom of the leg panel 16 by a second panel connection 44. The inner elongated member 41 of the telescoping shaft assembly 40 extends furthur out of the main portion when the leg panel 16 is moved to the position indicated at 46.

Figure 2:
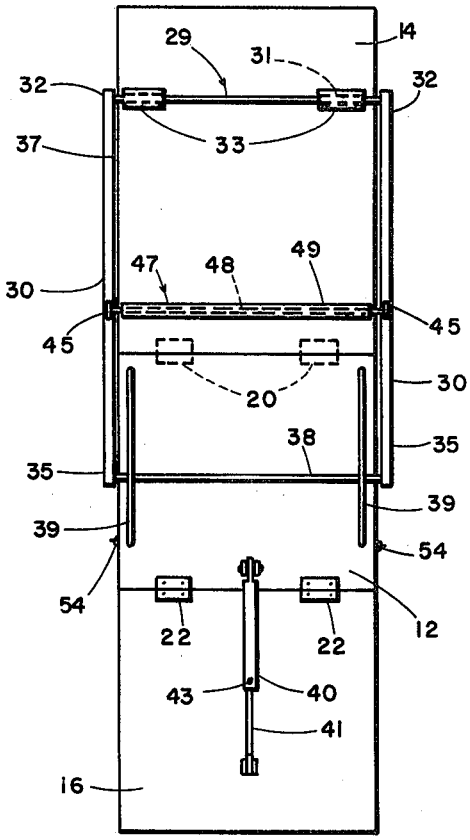
FIG. 2 is a bottom plan view of the lower section of the patient handler, shown in a position suitable for a patient in a prone position

A keeper screw 43 retains the telescoping shaft assembly 40 in an extended position as seen in FIG. 2. The keeper screw can also be rotatably loosened, allowing the inner elongated member 41 to slide into the outer elongated member, when the patient handler is to be in a sitting position, as seen in FIG. 1.

A flexible support assembly 53 connects the stiff means 30 and the buttocks panel 12 to a carriage assembly 57, and comprises both a right and left flexible handler holder 50 extending from the point 32 to a ring 52, and from the ring 52 to the buttocks panel 12 as indicated at 54.

Figure 1A:
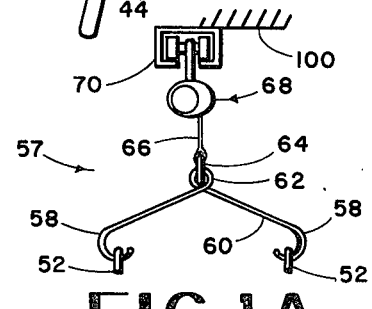
FIG. 1A is a frontal elevation of a carriage assembly which is an upper portion of the patient handler of FIG. 1, the carriage assembly suspends the lower portion of the handler shown in FIG. 1, and has a track attached to a ceiling.

In FIG. 1A a carriage assembly 57 is shown having both a right and left hook 58 for holding the rings 52. The hooks are formed from the ends of a carriage bar or supporting bar 60 which is of a length substantially equal to the distance between the right and left stiff brace 30, and which attaches to an eye 62 at the approximate center of its length. A snap hook 64 is attachable to the eye 62, and connected to a cable 66, which ends in a winch and track roller assembly 68, which travels along a track 70 attached to a ceiling 100.

Referring to FIG. 2, the rearward end portion 37 of the stiff brace 30 is attached to an attaching assembly 29 which connects the right and left stiff brace, the connecting bar 31 is held to the underneath side of the back panel by rod holders 33 having openings into which the connecting bar is insertable, the connecting bar being rotatable on a horizontal axis.

The forward end portion 35 of the stiff brace 30 is attached to a second connecting bar 38 connecting the right and left stiff braces, the connecting bar 38 moves along a slot 34 of FIG. 1, which is formed by a track bar 39 extending below and parallel with the bottom of the buttocks panel 12.

In FIG. 2, the hinges 22 are shown to be on the underneath side of the patient handler while the hinges 20 are shown to be on the upper side.

The inner elongated member 41 of the telescoping shaft assembly 40 is shown to be extended in this view as the patient handler is in a prone position.

The hinge 20 is such that it helps to retain the back panel 14 and the buttocks panel 12 in substantial parallelism with each other.

The hinge 22 is such that it helps to retain the buttocks panel 12 and the leg panel 16 substantially parallel and substantially in alignment with each other.

The stiff means also helps to retain the back panel 14 and the buttocks panel 12 in a position substantially parallel and substantially in alignment with each other, when an anchoring bar 48 is inserted through the anchor openings 45, and the anchoring sleeve 49, which is attached to the underneath side of the back panel 14.

The telescoping shaft assembly 40 also helps retain the buttocks panel 12 and the leg panel 16 in a position substantially parallel and in alignment with one another. The keeper screw 43 holds the inner elongated member in place and is shown to be rotatably insertable into the main portion of the telescoping shaft assembly 40.

Figure 3:
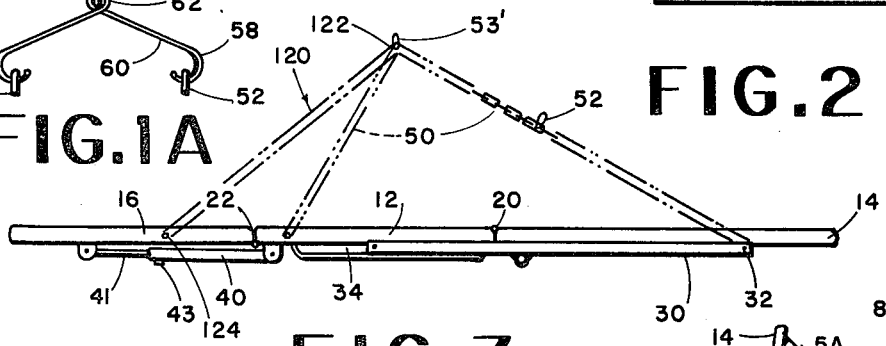
FIG. 3 is a side elevation of the lower section of the patient handler, shown in a position suitable for a patient in a prone position, with the flexible handler holder partially diagramatically shown and positioned as though attached to the carriage assembly at a point along its length for prone panel holding. An extra connection section of the flexible handler holder is shown as being attached to a leg panel to support it, as is useful when other leg panel supports are not used.

In FIG. 3 the patient handler is shown as being in a position suitable when the patient being handled is in a prone position.

A second ring 53' on both the right and left flexible handler holders is connectable to the hooks, 58 of FIG. 1A, and is connected to the hooks 58 when the patient is in a prone position.

When the patient is in a prone position, as shown in FIG. 3, both the right and left stiff brace 30 are parallel and adjacent to the back panel 14 and the buttocks panel 12, which are substantially horizontal and substantially in alignment with each other.

In FIG. 3, an extra flexible support assembly 120 is used to give extra support to the leg panel 16, and is connected to the ring 53' at a point 122, and to the leg panel 16 at point 124.

The inner elongated member 41 of the telescoping shaft assembly 40, in FIG. 3 is extended for support of the leg panel 16 in the same maner as in FIG. 2.

Figure 4:
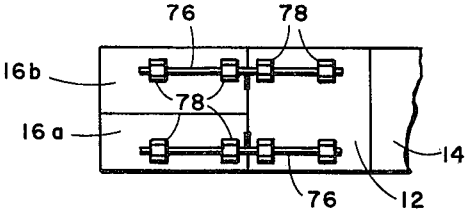
FIG. 4 is a bottom plan view of a modification of the patient holder shown with a portion of the back panel broken away, the patient handler being in a prone position. In this modification a stiff stabilizing assembly is used to maintain the buttocks and leg panels of the patient handler in substantial alighment with each other. This view also shows two leg panels replacing the single panel shown in FIG. 2.

In FIG. 4 a stiff stabilizing assembly maintains the leg panel and buttocks panel substantially horizontal and substantially in alignment with each other. Stabilizer rods 76 are held adjacent to and parallel with both the buttocks panel 12 and the leg panels **16*a* and 16*b*, by means of stabilizer holders 78 attached to the buttocks panel 12 and the leg panels 16*a*, and 16*b***.

In the modification shown in FIG. 4, two leg panels **16*a* and 16*b*, one for each leg, replace the single leg panel of FIG. 1**.

The stabilizer holders, 78 of FIG. 4, have openings of a size suitable for easy removal of the stabilizer rods 76 therefrom. When the stabilizer rods are removed, the leg panels **16*a* and 16*b* hinge to a position substantially downward from the buttocks panel 12**, for use of the patient handler when the patient is in a sitting position.

Figure 5:
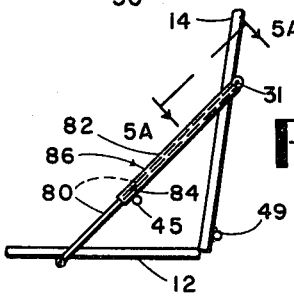
FIG. 5 is a side elevation of a modification of the patient handler lower section, showing the back panel and the buttocks panel, but not showing a leg panel or a flexible handler holder. The patient handler in this view has a telescoping shaft assembly pivotably and non-slidably attached to both the back and buttocks panels.

In FIG. 5, the stiff brace 86 comprises a telescoping shaft assembly connecting to the attaching assembly, 29 of FIG. 2, at the closed end of the outer elongated member 82, and attaching to an attaching assembly, not seen in FIG. 5, substantially identical to that described earlier in relation to FIG. 2.

In FIG. 5, the inner elongated member 80 of the telescoping shaft assembly 86 being of such a length that its unconnected end meets with the connected end of the outer elongated member 82, thus preventing the back panel and the buttocks panel from folding together.

Anchor openings 45 on both the right and left stiff brace 86 align with an anchoring sleeve 49 on the underneath side of the back panel 14. An anchoring bar, not seen, is insertable through the anchor openings 45 and the anchoring sleeve 49, and provides support when the patient handler is in a prone position, not seen but substantially identical to that shown in FIGS. 2 and 3.

Figure 5A:
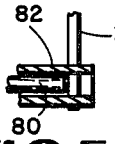
FIG. 5A is a sectional view taken along line 5A—5A but not showing the back panel, the upper side of the top end of the outer section of the telescoping shaft assembly being removed, and the remainder of the top end being shown in cross section.

FIG. 5A is a sectional view taken along line 5A—5A, but not showing the back panel 14, the top of the outer section 82 of the telescoping shaft assembly 86 being removed in this view, and the interior being shown in cross section.

The inner elongated member 80 of the telescoping shaft assembly 86, slides through the outer elongated member 82 until meeting with the connecting bar 31 of the attaching assembly, 29 of FIG. 2.

In FIG. 3, an extra flexible support assembly 120 is used to give extra support to the leg panel 16, and is connected to the ring 53' at a point 122, and to the leg panel 16 at point 124.

I claim:

1. A patient handler comprising a buttocks support panel having a substantially horizontal upper surface, a back support panel having an upper surface disposable substantially horizontal and substantially in alignment with the upper surface of said buttocks panel, for use when the patient being handled is in a prone position, said back panel having an inner end adjacent a rearward end of said buttocks panel, hinge means interconnecting said inner end of said back panel to said rearward end of said buttocks panel for the hinging of said back panel with respect to said buttocks panel about a horizontal first axis, said back panel being disposed substantially upwardly extending from said buttocks panel at a time when said panels are in a position for holding a patient in a sitting position, a limiting assembly disposed during sitting position times between a first point adjacent said back panel and spaced a substantial distance from said first axis and a second point adjacent said buttocks panel and spaced a substantial distance from said first axis, said limiting assembly having a stiff means extending between said points, attaching means attaching said stiff means to said back and buttocks panels and capable of preventing movement of said stiff means along said back panel beyond said first point and preventing movement of said stiff means along said buttocks panel beyond said second point during sitting position times, said stiff means being stiff in portions thereof between said points during sitting position times, said attaching means permitting said stiff means to move so that said back panel can be moved from its sitting times position to its prone times position, said buttocks and said back panels comprising a pair of main panels, said panels having back and forward sides facing in opposite directions from said first axis when said back and buttocks panels are in prone position, said panels having right and left sides at opposite ends of said first axis, a supporting assembly attached to said panels and suspending said panels in said sitting times positions when said panels are in said positions for sitting times, said supporting assembly being provided with right and left suspension assemblies attached to right and left sides of said main panels and a supporting bar extending from right to left and upholding upper ends of said suspension assemblies at spaced places thereon respectively, said supporting bar having downwardly extending right and left arms to the lower ends of which said right and left suspension assemblies are respectively connected, said right and left suspension assemblies each being a right and left flexible means having a rearward end connected to said back panel and a forward end connected to said buttocks panel, each of said flexible means being of a length substantially greater than the distance between the points on said panels to which the ends of the respective flexible means is attached whereby when said flexible means are taut they will be disposed extending from said back panel upwardly and to a central connection point and then extending downwardly to said buttocks panel.

2. The patient handler of claim 1 having said limiting assembly having releasable holding means operatively associated with said stiff means and causing said stiff means to hold said main panels with their upper sides in substantial alignment during prone position times.

3. The patient handler of claim 2 in which said releasable holding means comprises said stiff means having a first anchoring means thereon disposed between said points, one of said main panels having a second anchoring means thereon disposed between said points, and a releasable means for interconnecting said two anchoring means for holding said anchoring means together at prone position times, whereby at prone position times, said main panels are held together with their upper surfaces substantially in alignment and whereby when said releasable interconnecting means is released then said first and second anchoring means can move apart from each other so that said stiff means is free to assume a position extending at an acute angle with respect to the horizontal permitting said back panel to assume an upwardly extending position with respect to said buttocks panel.

4. The patient handler of claim 1 further comprising a leg support panel means having an upper surface disposed substantially horizontal and substantially in alignment with the upper surface of said buttocks panel during prone position times, said leg panel means having an inner end adjacent to a forward end of said buttocks panel, a second hinge means connecting said inner end of said leg panel means to said forward end of said buttocks panel for the hinging of said leg panel means with respect to said buttocks panel about a horizontal axis, said leg panel means being disposed substantially downwardly from said buttocks panel during sitting position times.

5. The patient handler of claim 4 having a telescoping shaft assembly being attached to and extending from the lower surface of the buttocks panel, said shaft assembly extending to and attaching to the lower surface of of said leg panel means, said shaft assembly comprising an outer elongated member, an inner elongated member slidable lengthwise of said outer elongated member and keeper means releasably adjustable to hold said telescoping shaft assembly at an elongation for holding said leg panel means in position for prone position use with its upper surface substantially parallel and in alignment with said upper surface of said buttocks panel.

6. The patient handler of claim 4 having said leg support panel means being two separate panels, each having an inner end adjacent to the forward end of said buttocks panel, said inner ends of said leg panels being hingably attached to said forward end of said buttocks panel.

7. The patient handler of claim 1 having a carriage assembly comprising a track attaching to a ceiling, a winch and track roller assembly having a portion thereof rollable in said track.

8. The patient handler of claim 1 having said limiting assembly having an outer sleeve, a shaft slidably disposed inside said sleeve, means attaching an outer end of said shaft to one of said points, means attaching said sleeve to other of said points, said limiting assembly having a stop means thereon held by said sleeve and adapted to be engaged by the inner end of said shaft at a time when said back panel is in a sitting position, for limiting compression of said telescoping shaft assembly so as to prevent said panels from folding towards each other from said sitting position.

9. A patient handler comprising a buttocks support panel having a substantially horizontal upper surface, a back support panel having an upper surface disposable substantially horizontal and substantially in alignment with the upper surface of said buttocks panel, for use when the patient being handled is in a prone position, said back panel having an inner end adjacent a rearward end of said buttocks panel, hinge means interconnecting said inner end of said back panel to said rearward end of said buttocks panel for the hinging of said back panel with respect to said buttocks panel about a horizontal first axis, said back panel being disposed substantially upwardly extending from said buttocks panel at a time when said panels are in a position for holding a patient in a sitting position, a limiting assembly disposed during sitting position times between a first point adjacent said back panel and spaced a substantial distance from said first axis and a second point adjacent said buttocks panel and spaced a substantial distance from said first axis, said limiting assembly having a stiff means extending between said points, attaching means attaching said stiff means to said back and buttocks panels and capable of preventing movement of said stiff means along said back panel beyond said first point and preventing movement of said stiff means along said buttocks panel beyond said second point during sitting position times, said stiff means being stiff in portions thereof between said points during sitting position times, said attaching means permitting said stiff means to move so that said back panel can be moved from its sitting times position to its prone times position, said buttocks and said back panels comprising a pair of main panels, said panels having back and forward sides facing in opposite directions from said first axis when said back and buttocks panels are in prone position, said panels having right and left sides at opposite ends of said first axis, a supporting assembly attached to said panels and suspending said panels in said sitting times positions when said panels are in said positions for sitting times, said supporting assembly being provided with right and left suspension assemblies attached to right and left sides of said main panels and a supporting bar extending from right to left and upholding upper ends of said suspension assemblies at spaced places thereon respectively, said limiting assembly having releasable holding means operatively associated with said stiff means and causing said stiff means to hold said main panels with their upper sides in substantial alignment during prone position times, said releasable holding means comprising said stiff means having a first anchoring means thereon disposed between said points, one of said main panels having a second anchoring means thereon disposed between said points, and a releasable means for interconnecting said two anchoring means for holding said anchoring means together at prone position times, whereby at prone position times, said main panels are held together with their upper surfaces substantially in alignment and whereby when said releasable interconnecting means is released then said first and second anchoring means can move apart from each other so that said stiff means is free to assume a position extending at an acute angle with respect to the horizontal permitting said back panel to assume an upwardly extending position with respect to said buttocks panel.

* * * * *